US007345578B2

(12) United States Patent
Holt et al.

(10) Patent No.: US 7,345,578 B2
(45) Date of Patent: Mar. 18, 2008

(54) ELECTRONIC BAGGAGE TAG WITH PACKING REMINDER FUNCTION

(75) Inventors: H. Tate Holt, Larkspur, CA (US); Lindsay Beth Kamm, San Anselmo, CA (US)

(73) Assignee: Nagtags LLC, San Anselmo, CA (US)

( * ) Notice: Subject to any disclaimer, the term of this patent is extended or adjusted under 35 U.S.C. 154(b) by 269 days.

(21) Appl. No.: 11/160,583

(22) Filed: Jun. 29, 2005

(65) Prior Publication Data

US 2007/0001847 A1 Jan. 4, 2007

(51) Int. Cl.
*G08B 1/00* (2006.01)
*G08B 23/00* (2006.01)
*G09F 3/20* (2006.01)

(52) U.S. Cl. ..... 340/309.7; 340/693.5; 340/321; 40/6

(58) Field of Classification Search ..... None
See application file for complete search history.

(56) References Cited

U.S. PATENT DOCUMENTS

| | | | | |
|---|---|---|---|---|
| 5,145,211 | A | 9/1992 | McKillip | 283/80 |
| 5,510,768 | A | 4/1996 | Mann | 340/571 |
| 6,027,027 | A | 2/2000 | Smithgall | 235/488 |
| 6,295,747 | B1 | 10/2001 | Francis | 40/6 |
| 6,624,752 | B2 * | 9/2003 | Klitsgaard et al. | 340/572.1 |
| 6,671,987 | B1 | 1/2004 | Fenton | 40/6 |
| 7,165,349 | B2 * | 1/2007 | Bauer | 40/654 |
| 2003/0122268 | A1 * | 7/2003 | Nagasaka et al. | 261/122.1 |
| 2006/0266563 | A1 * | 11/2006 | Kaplan | 177/245 |
| 2006/0266583 | A1 * | 11/2006 | Jones | 182/107 |

* cited by examiner

*Primary Examiner*—Julie Lieu

(57) ABSTRACT

An electronic baggage tag, attachable to the handle of a piece of baggage, for creating and reviewing a checklist of items to be packed in the bag. The tag includes a display screen, manually operable controls for selecting commands and items displayed on the display screen, a software program, a processor, a memory, and circuitry suitable for operating the software. Stored in the memory is a master list of potential contents, from which a packing checklist is created and stored in memory for later use, and a data access routine executable by the processor which is operable to display the items on the checklist.

8 Claims, 12 Drawing Sheets

ELECTRONIC BAGGAGE TAG WITH PACKING REMINDER FUNCTION

CROSS-REFERENCE TO RELATED APPLICATIONS

None.

FEDERALLY SPONSORED RESEARCH

None.

SEQUENCE LISTING OR PROGRAM

None.

BACKGROUND OF THE INVENTION

1. Field of Invention

This invention generally relates to baggage tags, in particular, tags which provide a means of ensuring that correct items are packed.

2. Prior Art

Many different forms of baggage exist. Some are intended for general purposes and others have been designed specifically to carry clothing, vocational or sporting equipment, personal items, books, papers, or nutritional items. The term "bag" or "baggage" refers generically to all manners of luggage, suitcases, briefcases, garment bags, sporting bags, general purpose totes, school book bags and backpacks, diaper bags, camera bags, and the like.

Previously, baggage tags which attached to the handle of a piece of baggage provided a means of displaying indicia of the identification of the owner or user of the bag, the routing of the bag, or the destination of the bag. Without a means of reminding the user of the bag exactly what contents should be packed, however, the user could arrive at their destination lacking essential clothing, equipment, or supplies.

The baggage tag in U.S. Pat. No. 6,219,947 to Francis, Apr. 24, 2001, provided a means for ownership identification and routing destination. The baggage tag in U.S. Pat. No. 5,145,211 to McKillip, Sep. 8, 1992, provided a means for identification and claiming of bags at their destination. The baggage tag in U.S. Pat. No. 6,671,987 to Fenton, Jan. 6, 2004, provides a means of distinguishing bags of similar appearance.

However, none of the prior-art tags provides a means of reminding the user of a bag what specific items should be packed within it. If a person forgets to pack a certain medicine in their luggage, their health or treatment could be jeopardized or their travel schedule unduly inconvenienced. If a child forgets to include a certain book or homework assignment in their school back pack, their grades or self-image could be adversely affected. If an athlete forgets to pack a certain piece of uniform or equipment in their sports bag, they may not be able to compete effectively, or even compete at all.

BACKGROUND OF INVENTION—OBJECTS AND ADVANTAGES

Accordingly, several objects and advantages of the baggage tag are:

(a) to provide a means of easily and conveniently reminding the user what to pack in the bag so necessary items are not forgotten;

(b) to provide a means of easily and conveniently suggesting many potential contents to the user so all necessary items are packed;

(c) to provide a means of suggesting potential contents by category so all necessary items are conveniently and easily packed;

(d) to provide a means of easily suggesting necessary items to pack so the user can accomplish packing without assistance;

(e) to provide a means of easily and quickly suggesting necessary items to pack so the user can tailor their check list according to the needs of a specific day or event.

Further objects and advantages of our baggage tag will become apparent from a consideration of the drawings and ensuing description.

SUMMARY

In accordance with the invention, a baggage tag comprises a slim, flat body having a means of displaying indicia of necessary contents, a means on said flat body for pointing to and selecting information displayed, and a tether for attaching said tag to a bag.

DRAWINGS—FIGURES

DRAWINGS—REFERENCE NUMERALS

10 Front Cover
20 LCD Screen
30 "Up" Button
40 "Right" Button
50 "Down" Button
60 "Left" Button
70 Slot for receiving tether to bag
80 On/Off Switch
110 BackCover
120 Battery Cover
210 Integrated Circuit Board
220 Batteries
510 Enclosure of Alternative Embodiment
520 Display Screen of Alternative Embodiment
530 Keypad

DETAILED DESCRIPTION—PREFERRED EMBODIMENT—FIG. 1

Figure 1:
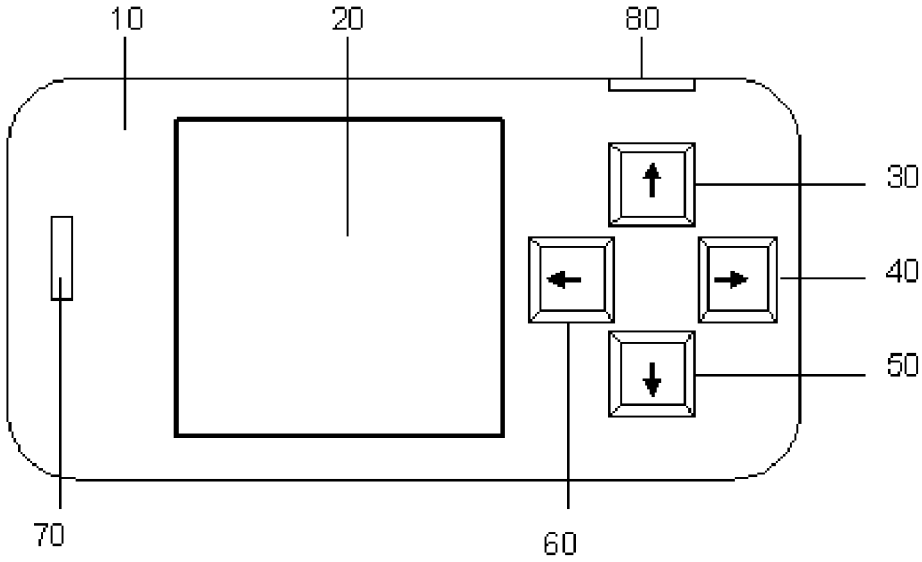
FIGS. 1 to 3 show the front, back, and frontal perspective views of the preferred embodiment of the invention.

A preferred embodiment of the baggage tag is illustrated in FIG. 1 (front view). The baggage tag comprises a back cover made of a durable plasticized material upon which lies an integrated circuit (IC) board. Resting upon IC board 210 at strategic locations are several other components, specifically four buttons made of a durable plasticized material for pointing to commands and items displayed on the display screen; an "Up" button 30, a "Right" button 40, a "Down" button 50, and a "Left" button 60. Also connected to the IC board is an "On/Off Switch" 80 made of a durable plasticized material. A front cover 10 is made of a durable plasticized material, which attaches to back cover 110 by a set of interlocking flanges. Front cover 10 has holes through which the top portions of buttons 30, 40, 50, and 60 protrude, thereby securing the buttons in place. Front cover 10 also has a hole through which the front surface of an LCD screen 20 can be seen, and another hole 70 to receive a tether for attaching the tag to the baggage.

In the preferred embodiment, front cover 10, back cover 110, a battery cover 120, buttons 30, 40, 50, 60, and on/off switch 80 are made of a durable plasticized material, such as polystrylene plastic available from Epsilon Industries of Chino, Calif. However, these parts can consist of any other durable material that can be suitably machined, such as metal or rubber.

IC board 210 comprises circuits to connect buttons 30, 40, 50, 60, and on/off switch 80 with such sub-components necessary to store, process, and display the results achieved by the software described below. The sub-components specifically include a processor chip and a memory controller chip available from Intel Corporation of Santa Clara, Calif., an LCD available from Wanxin Display of Arcadia, Calif., and batteries 220 available from Energizer Incorporated of Milford, Conn.

Figure 2:
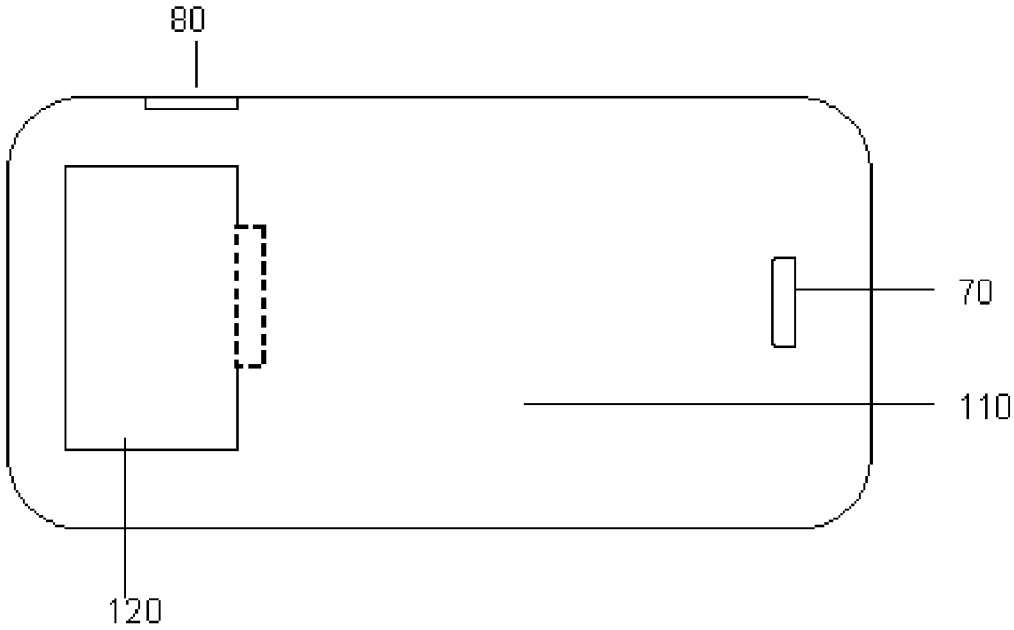

FIG. 2 shows the back view of the baggage tag. Back cover 110 shows hole 70 and a hole to receive battery cover 120. Batteries 220 rest upon the rear side of IC board 210. Battery cover 120 attaches to the back cover with an interlocking flange.

Figure 3:
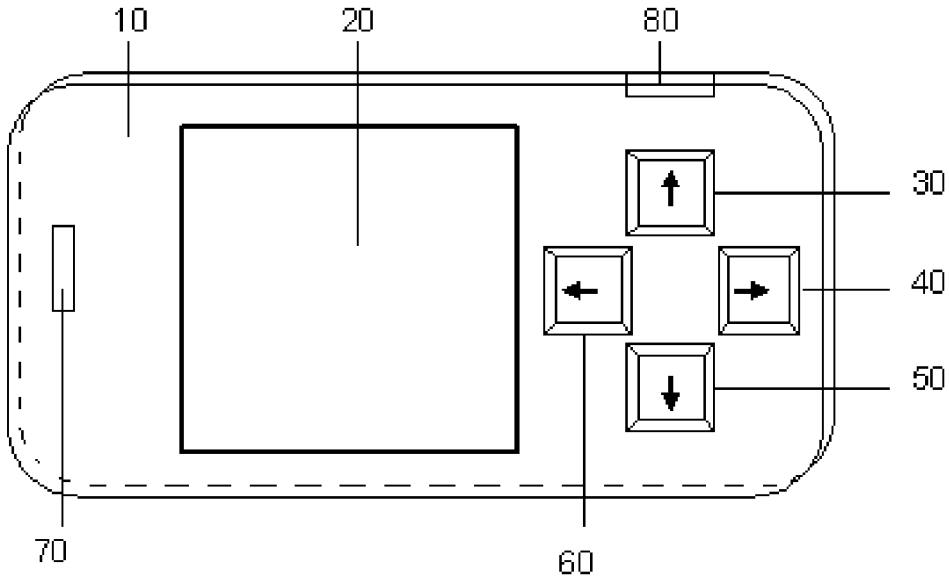

FIG. 3 shows the frontal perspective view of the baggage tag.

Operation—Preferred Embodiment—FIGS. 4-8

The preferred embodiment of the baggage tag has two basic functions; a set up function to create a checklist of specific items to pack in the bag, and a checklist function to provide a means of reviewing the created list when packing.

Holding the tag with buttons 30, 40, 50, 60, and LCD screen 20 facing the user (FIG. 4), the user depresses on/off switch 80 to supply electrical power to all components. Displayed on the center of screen 20 is a cursor 90. The user can direct cursor 90 to various places on the screen by means of buttons 30, 40, 50, and 60, along with the phrases of a main menu, "Set Up" and "Check List".

Figure 5:
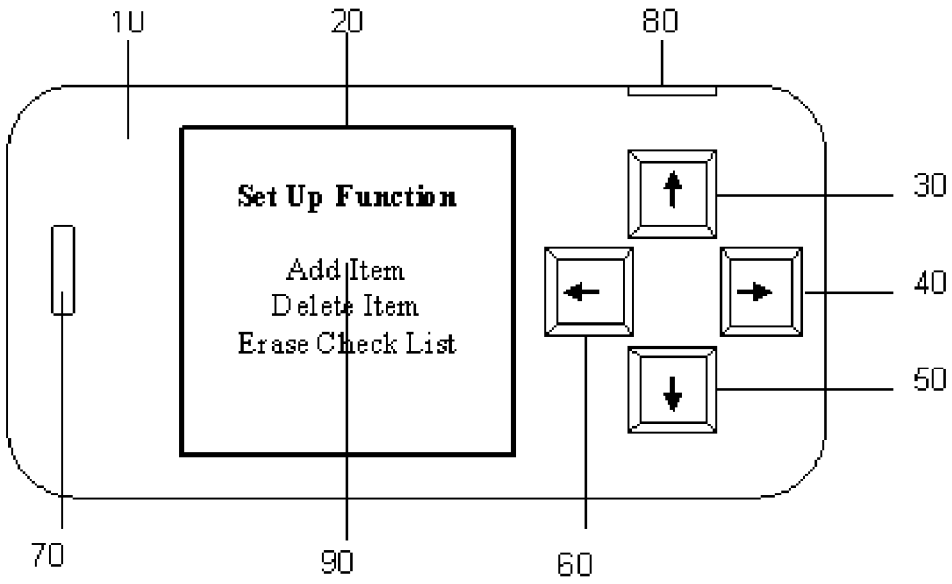

By depressing button 60, the user enters the "Set Up" mode, which creates and edits a check list of specific items which should be packed and stores the check list in memory. The set up mode menu comprises an "Add Item" command, a "Delete Item" command, and an "Erase Check List" command, as shown in FIG. 5. In the set up mode, the user can scroll up or down the list of editing commands by depressing buttons 30 or 50, respectively.

Should the user select the "Add Item" command by depressing button 40, a master list (FIG. 6) of several primary categories appears, such as clothing, equipment, nutrition, personal, paperwork, and other.

Figure 6:
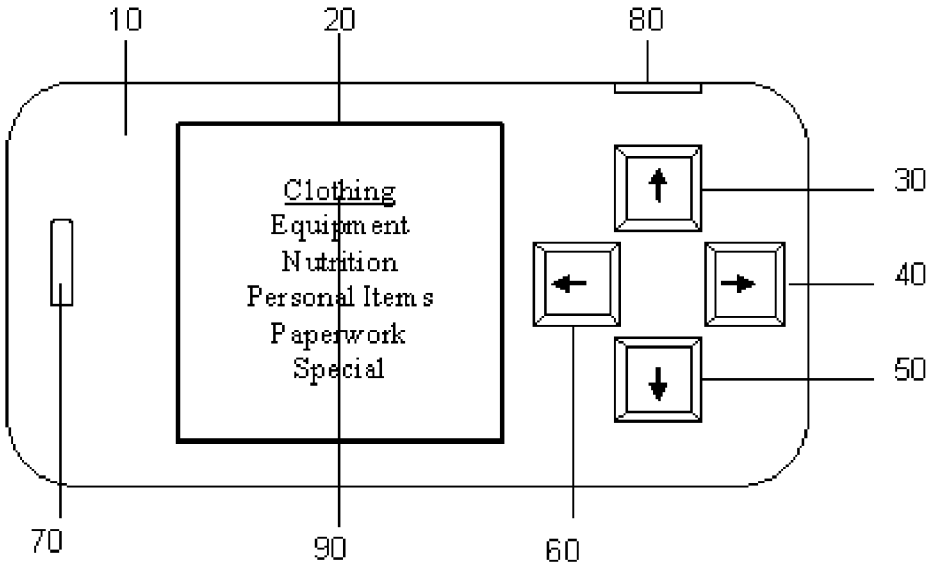

Cursor 90 initially indicates the top entry on the list of categories. The user may move cursor 90 down the list by depressing button 50, or back up the list by depressing button 30, until cursor 90 indicates the category desired by the user. By depressing button 40, the user selects the desired category, which comprises a list of related items that are arranged alphabetically, the first several of which items on the list appear on screen 20, along with the commands "Back" and "Select" (FIG. 6).

Figure 7:
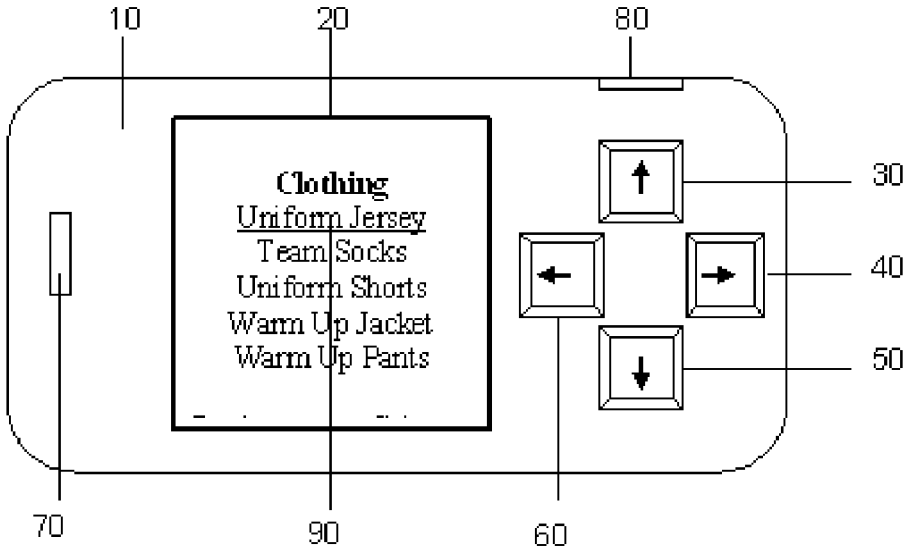
Figure 8:
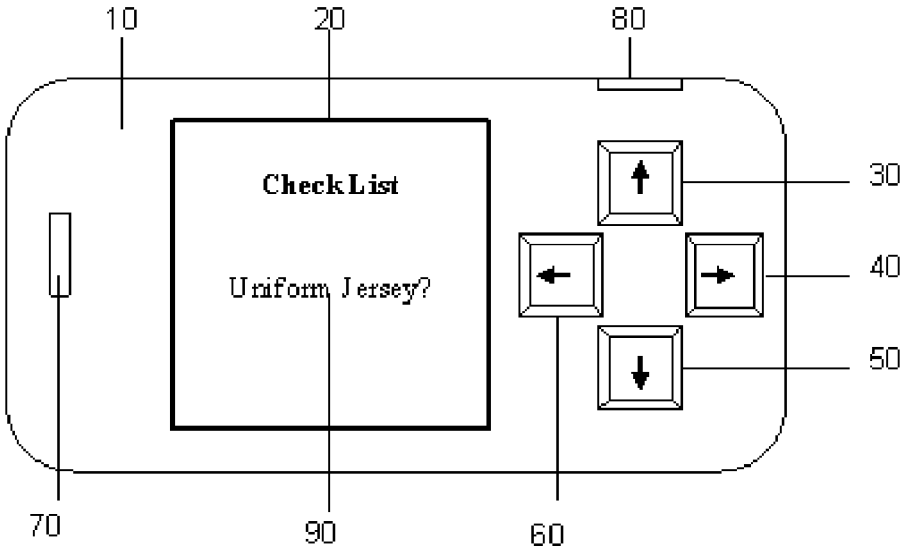

In this example, cursor 90 initially indicates the top entry on the list of items (FIG. 7). The user may move cursor 90 down the list by depressing button 50, or back up the list by depressing button 30, until cursor 90 indicates the item desired by the user. By depressing button 40, the user selects the desired item, which is thus entered into the memory chip on IC board 210. The user may continue to scroll up or down the list of items by depressing buttons 30 or 50, respectively. At any time the user may add an item to their check list by depressing button 40, or return to the list of categories by depressing button 60.

When the user enters the final item into memory, the electronic baggage tag is ready for later use. The user may turn the tag off by depressing button 80.

Figure 4:
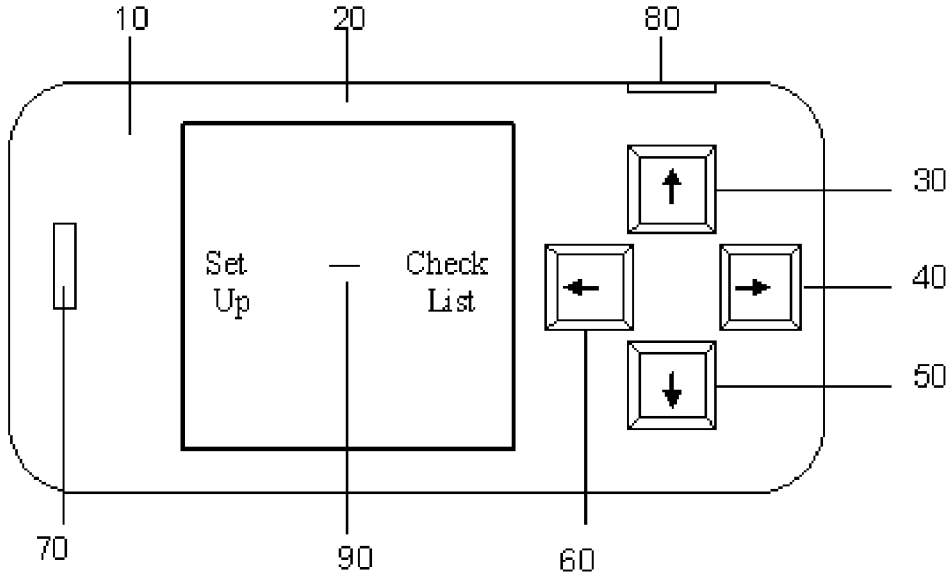
FIGS. 4 to 8 show the front view of the preferred embodiment of the invention.

When the user needs to pack their bag and use the baggage tag, on/off switch 80 is depressed and the main menu appears, with the "Set Up" and "Check List" modes, as shown in FIG. 4.

By depressing button 40, the user enters the "Check List" mode (FIG. 8) and the first item on their check list is displayed, along with the commands "Back" and "Got It!". If the user depresses button 40 to direct the cursor to the "Got It" command, then the next item on the checklist appears, and the process is repeated with the other items on the checklist. When the user completes the checklist in this manner, an encouraging message such as "You're done!" or "Have Fun!" appears. The tag may then be turned off by depressing button 80, or a software subroutine will turn the tag off automatically after a reasonable time, such as two minutes.

During the "Check List" mode, if the user depresses button 60 to direct cursor 90 to the "Back" command, then the previous item on the check list appears. If the user selects the "Back" command when the first item on the check list is displayed, they return to the main menu, as shown in FIG. 4.

The user may return to the "Set Up" function again at any time to edit the check list, using commands such as "Add Item", "Delete Item", and "Erase Check List" as shown in FIG. 5. The user can scroll up or down the list of editing commands by depressing buttons 30 or 50, respectively.

Should the user desire to add an item to the existing checklist, they select the "Add Item" command by depressing button 40. The user is thus returned to the list of primary categories, as shown in FIG. 6, and may search items and add them onto the checklist by using the same process described above.

In the Set Up function (FIG. 5) should the user desire to delete an item from the existing checklist, they move cursor 90 to the desired command by depressing button 50 and then select the command by depressing button 40. The user is thus presented with their existing checklist, which is arranged in the order in which the items were originally entered, along with the commands "Delete" and "Back".

To delete an item from the checklist, the user may move cursor 90 down the list by depressing button 50, or back up the list by depressing button 30, until cursor 90 indicates the item the user desires to delete. By depressing button 40, the user deletes the desired item, and may continue to scroll through the check list and delete additional items. By depressing button 60, the user returns to the main menu (FIG. 4).

The flowcharts in FIGS. 12-16 provide detail of the software program which resides in memory on IC board 210.

Figure 12:
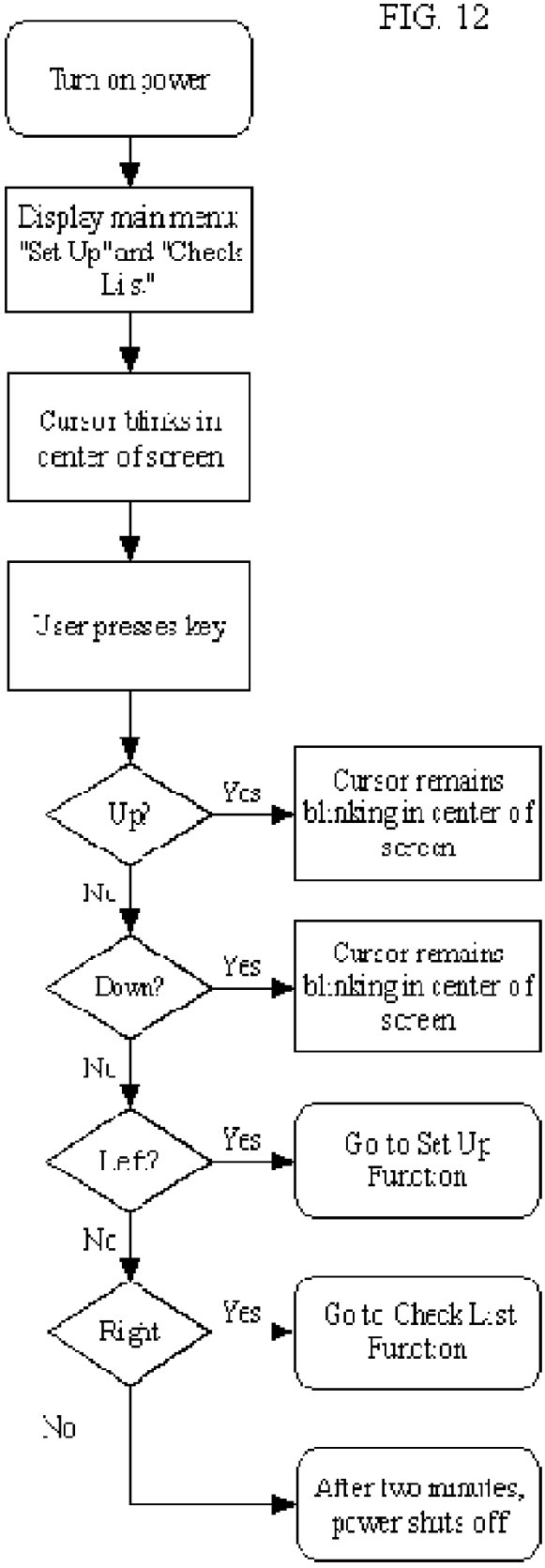
FIGS. 12 to 16 show flowcharts with details of the software program of the invention.
Figure 13:
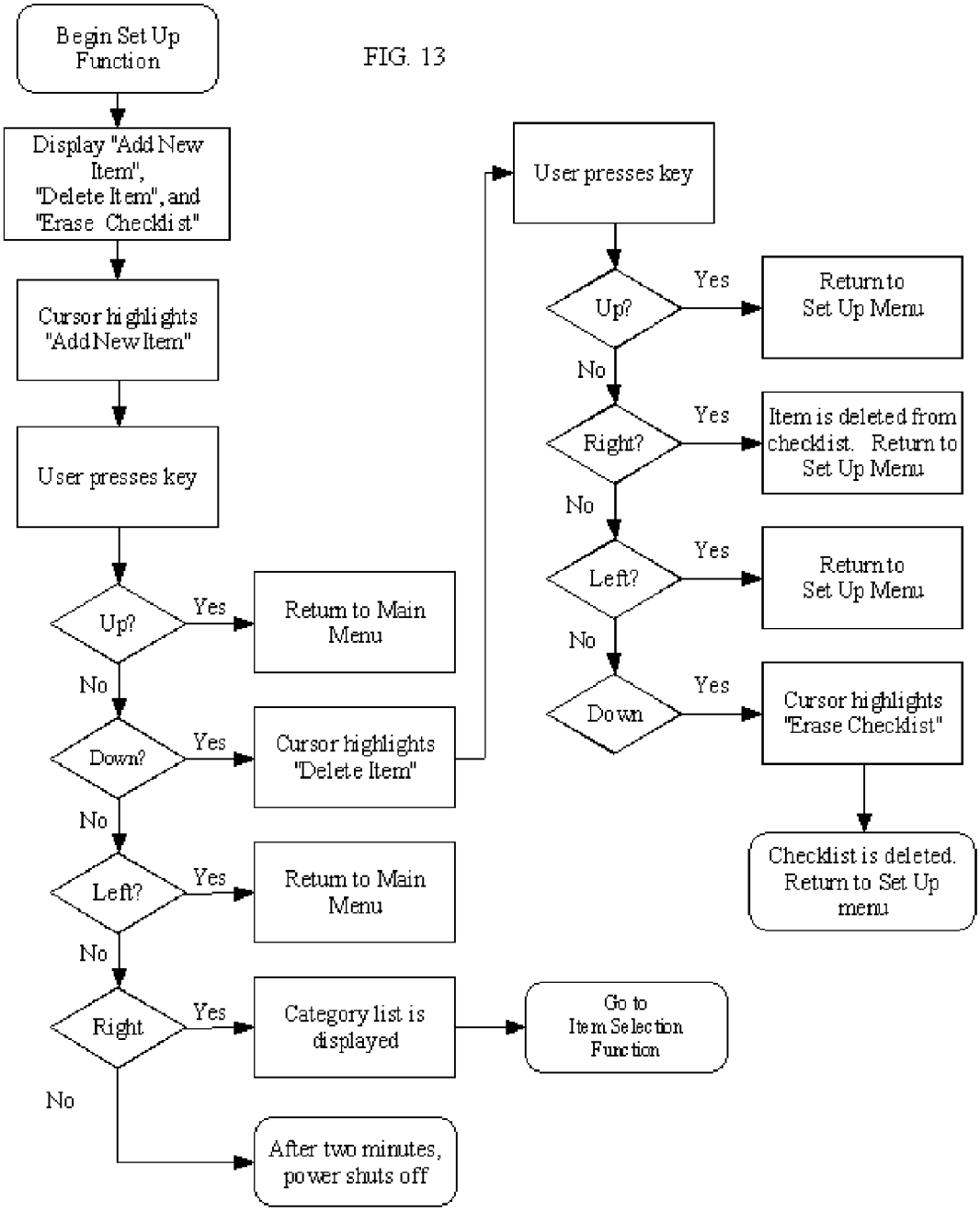
Figure 14:
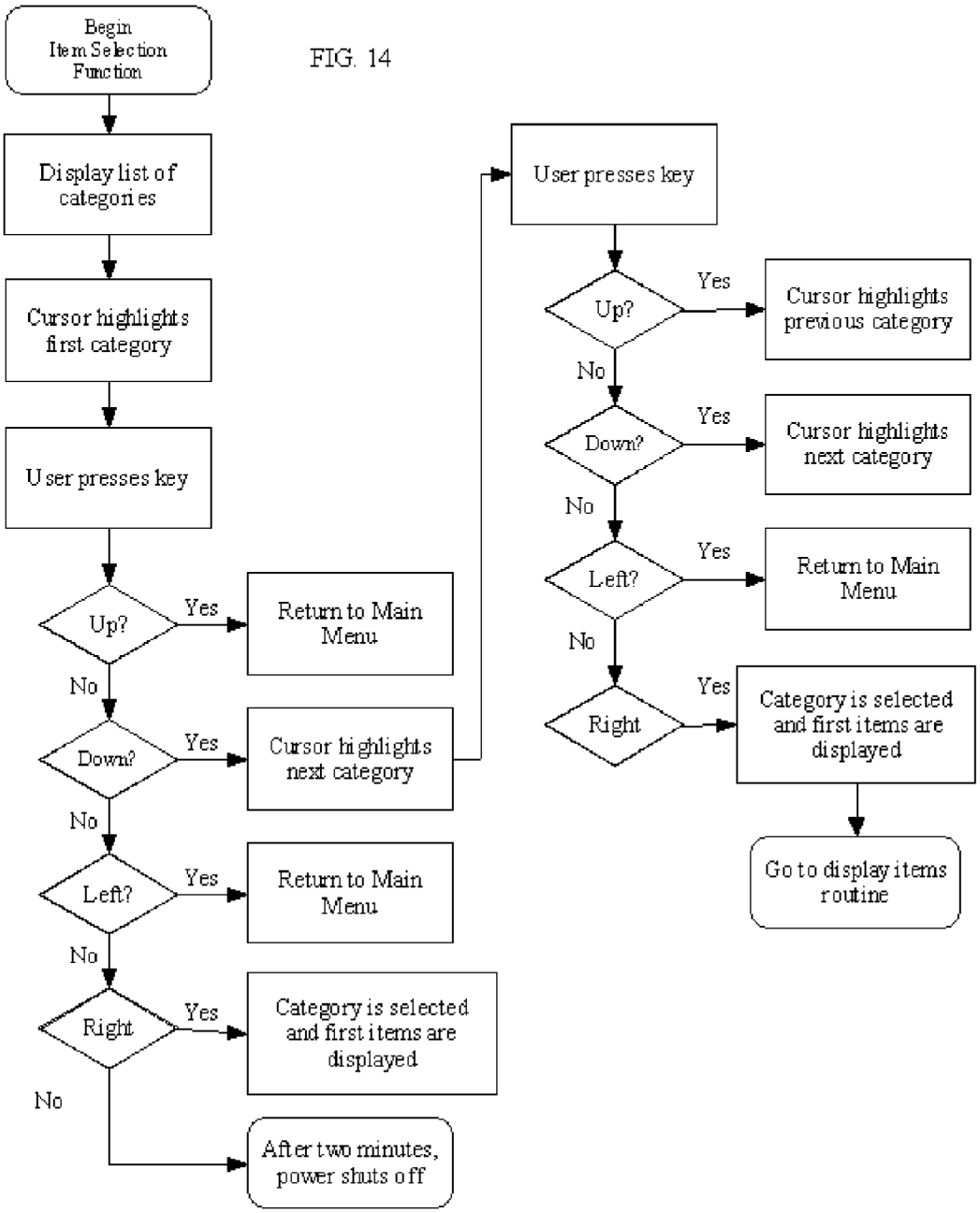
Figure 15:
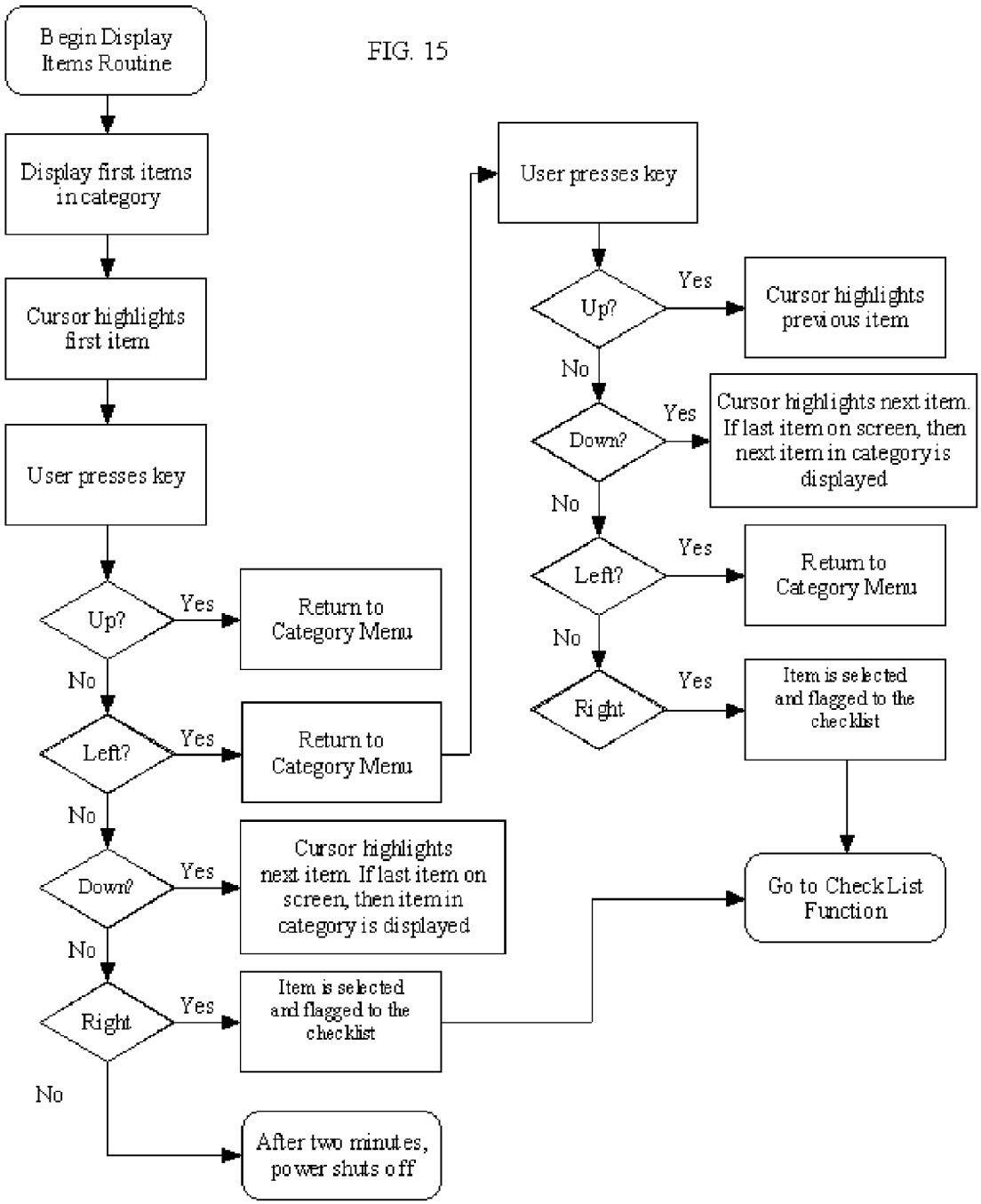
Figure 16:
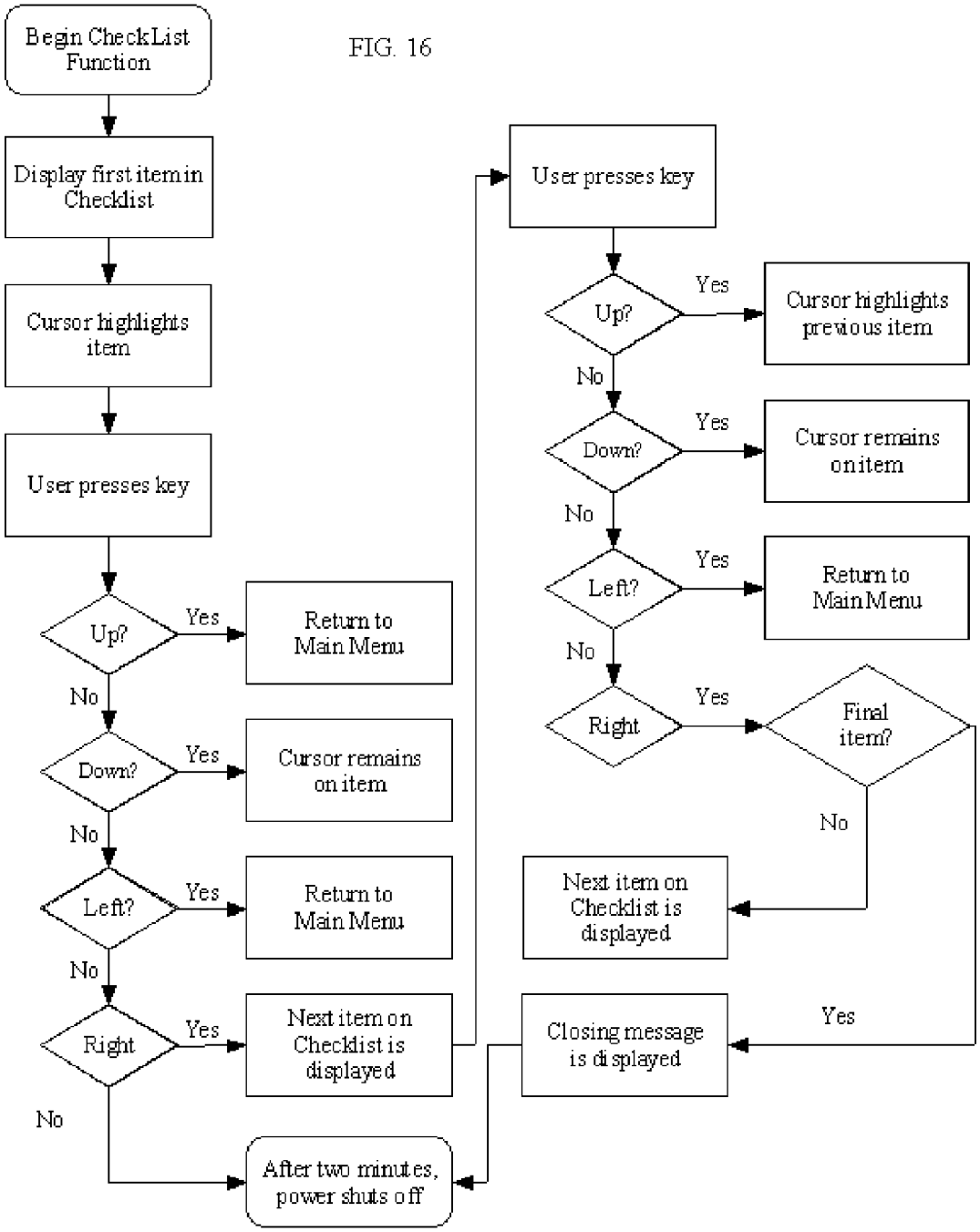

FIG. 12 is a flowchart of the program logic for the main menu access and exit. FIG. 13 is a flowchart of the program logic for the set up function. FIG. 14 is a flowchart of the program logic for selecting categories and items. FIG. 15 is a flowchart of the program logic for displaying master list items. FIG. 16 is a flowchart of the of the program logic for reviewing the checklist.

Advantages

From the description above, a number of advantages of our Electronic Baggage Tag become evident:

(a) The tag provides a means of easily and conveniently reminding the user what to pack in the bag, thus necessary items are not forgotten; the business traveler will not forget their medication, the grade school student will not forget their book or homework assignment, or the adolescent soccer player will not forget their team jersey, sunscreen, or tournament schedule.

(b) The tag provides a means of easily and conveniently suggesting an extensive list of potential contents the user might wish to pack, thus all necessary items are likely to be packed.

(c) The tag provides a means of suggesting potential contents by category, thus all necessary items are conveniently and easily packed.

(d) The tag provides a means of easily suggesting necessary items to pack, thus a child can accomplish packing of their sports bag or school back pack without requiring assistance from their parent. If the child has failed to include an essential item in the past, their parent will thus be prevented from feeling a need to nag them;

(e) The tag provides a means of easily and quickly suggesting necessary items to pack, thus the user can tailor the check list reminder according to the needs of a specific day or event.

Figure 9:
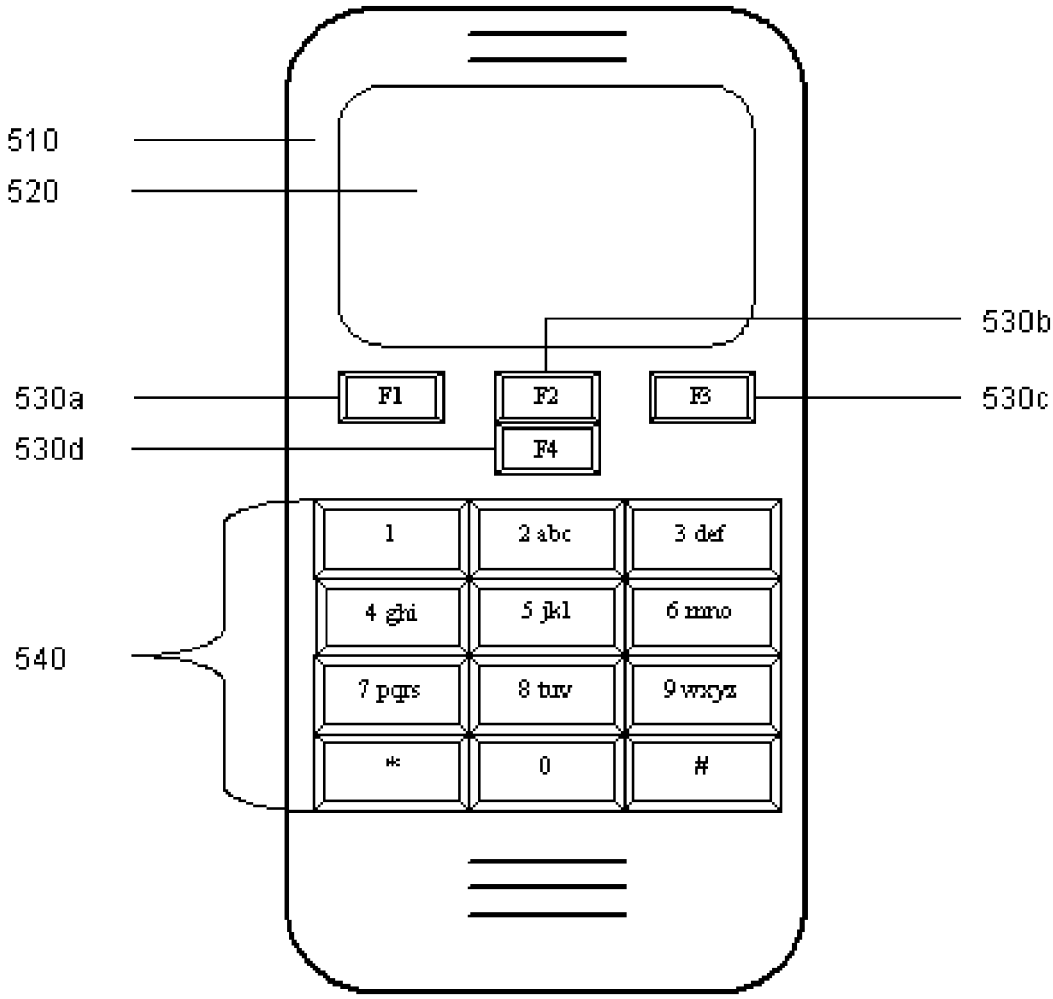
FIGS. 9 to 11 show the front view of an alternative embodiment of the invention.

Description—Alternative Embodiment—FIG. 9

FIG. 9 shows the front view of an alternative embodiment of the baggage tag. This embodiment comprises an enclosure 510, a display screen 520, a series of function keys 530*a*, 530*b*, 530*c*, and 530*d*, and a keypad 540.

Figure 10:
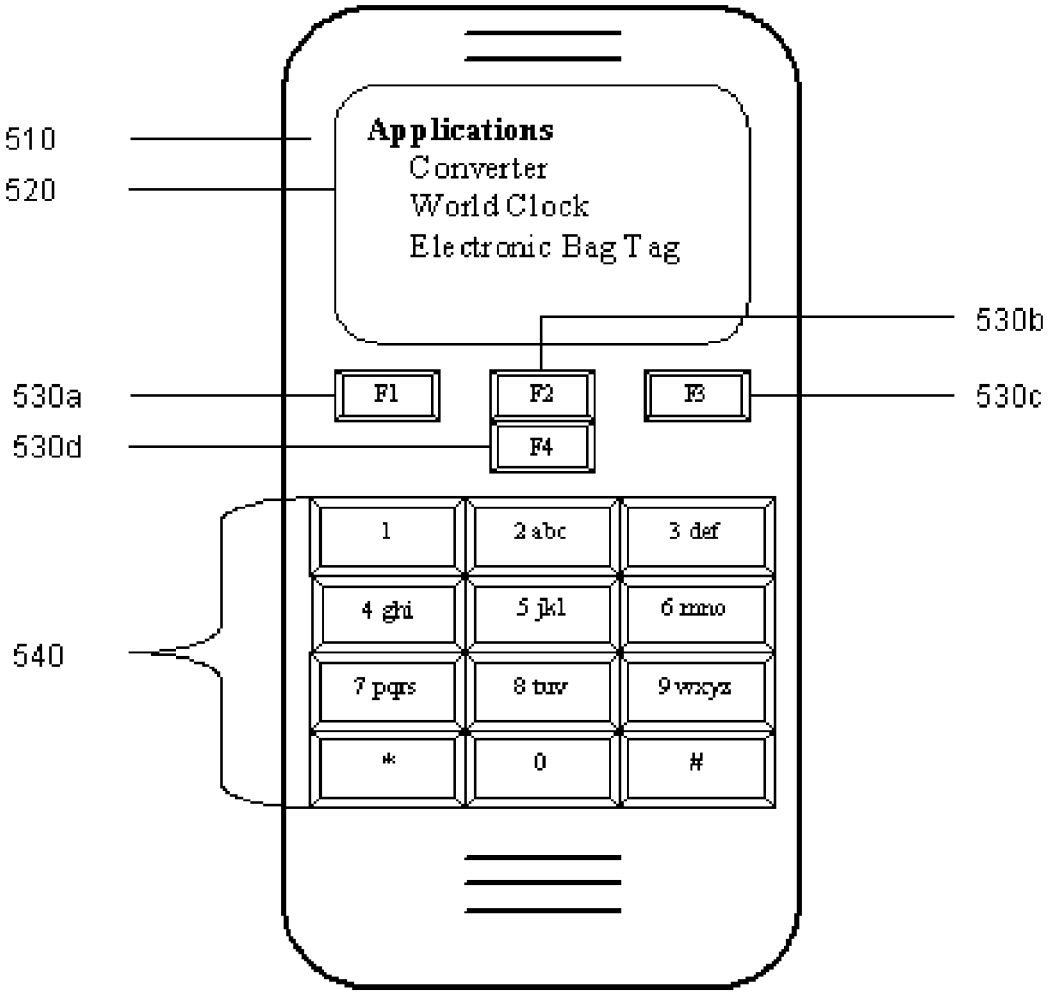
Figure 11:
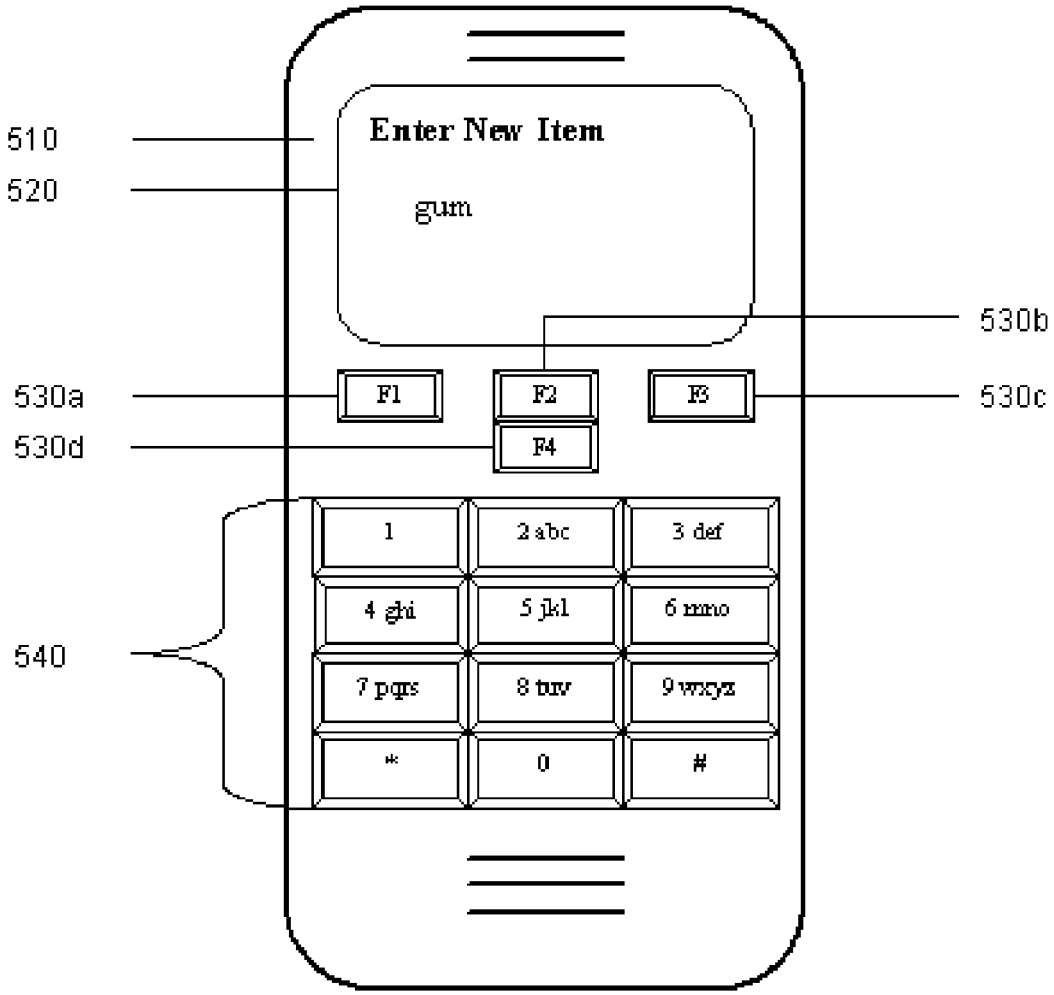

Operation—Alternative Embodiment—FIGS. 10-11

The alternative embodiment of the electronic baggage tag (FIG. 11) contemplates a software-only application version capable of operating on a handheld cellular telephone. The telephone comprises a display screen 520, function keys 530, keypad 540, as well as a memory, processor, and power supply functionally consistent with that detailed in the preferred embodiment.

As described above, the software-only embodiment comprises two basic functions; a Set Up function which provides a means of creating a checklist of specific items to pack in the bag, and a Check List function which provides the user a means of reviewing the created list when packing.

Holding the cellular telephone with display screen 520, function keys 530*a*, 530*b*, 530*c*, and 530*d*, and keypad 540 facing the user (FIG. 10) the user begins operation by selecting the baggage tag application from the appropriate menu of the cellular telephone. The operation is similar to that of the process described for the preferred embodiment, with the user depressing function keys 530*a*, 530*b*, 530*c*, and 530*d* as prompted to enter the selection desired.

This embodiment preferably includes the capability to store multiple checklists for multiple bags for multiple people, as well as the capability to enter new items onto the checklist that are not already included on the master list. Entering new items on the checklist is accomplished by using function keys 530*a*, 530*b*, 530*c*, and 530*d* to select the new item entry function and keypad 540 (FIG. 11) to spell out the letters of the word desired.

For example, if the user desired to add the word "gum" to the checklist, depressing the "4" key once would display the letter "g" on display screen 520. Depressing the appropriate function key permits the user to enter the next letter desired. Depressing the "8" key once displays the letter "t" and depressing the "8" key a second time displays the letter "u". Depressing the appropriate function key permits the user to enter the next letter desired. Depressing the "6" key once displays the letter "m" on the display screen, and depressing the appropriate function key permits the user to enter the completed word to their check list. Thus, the user can add unique items to their checklist, thereby tailoring their checklist to their individual needs.

CONCLUSION, RAMIFICATIONS, AND SCOPE

Accordingly, the reader will see that the electronic baggage tag can be used by persons of almost any age who are capable of reading to assist them in easily and efficiently packing their bags. Necessary items will not be forgotten, children can pack their school backpacks without assistance from their parents, and parents will not feel compelled to nag their children about remembering books and homework that should be taken to school.

While the above description contains many specificities, these should not be construed as limitations on the scope of the invention, but as exemplifications of the presently preferred embodiments thereof. Many other ramifications and variations are possible within the teachings of the invention. For example, different versions of the tag can be provided for different types of bags. While the operation of the tag would be identical, a tag intended for use on a general purpose gym bag would contain different checklist items than a tag intended for use on a diaper bag, and a tag intended for use on a suitcase would contain different checklist items than a tag intended for use on a golf bag or camera bag.

Although the shape of the baggage tag in the preferred embodiment is rectangular with rounded edges, the tag can have many other shapes, such as square, rectangular, circular, triangular, or novelty shapes, such as in the form of a book, a tennis racquet, or a flattened soccer ball.

Similarly, although the shape of buttons 30, 40, 50, and 60 is square, the buttons can be any other shape, such as rectangular, round, triangular, or in the form of arrows.

No colors have been specified for the component parts and there are many different color combinations that may be utilized in the manufacture of the tag. For example, as shown in FIGS. 1 and 2, front cover 10, back cover 110, and battery cover 120 can be of one color, and buttons 30, 40, 50, and 60 have a contrasting color. Alternatively, front cover 10 can be made of one color and back cover 110 and battery cover 120 be made of a contrasting color. Yet another embodiment of the tag utilizes a different color for each button 30, 40, 50, and 60.

A more complex IC board 210 can include features necessary for the tag to play previously-recorded sounds, or features necessary for the tag to accept input from another electronic device. The tag plays a tune when the user completes their checklist function, or the user can download a custom list of items, tunes, or games onto the tag from a computer via a wired cable, Universal Serial Bus, or wireless means of data transfer.

Accordingly, the scope of the invention should be determined not by the embodiments illustrated, but by the appended claims and their legal equivalents.

We claim:

1. An electronic device for reminding a user which contents to pack in a piece of baggage, comprising:

(a) a tag which is attachable to a piece of baggage, (b) a means for attaching said device to a handle of said baggage, (c) a memory which is able to store a plurality of commands and categories, said categories each comprising a multitude of related words, (d) a display which is operatively connected to said memory for displaying said commands and said categories and said words stored in said memory, (e) a pointer means which said user can manipulate to point to said commands and said categories and said words displayed on said display, (f) a memory controller which will:

(1) direct any word which said user selects via said pointer to a location in said memory, beginning at an address corresponding with the location of a checklist; and (2) direct any additional words which said user selects via said pointer to a location in said memory at subsequent checklist addresses in said memory so that all words selected are stored in said memory at said location; and (3) access said checklist from said memory, whereby said display will sequentially display all checklist words on said display, and said user can review said checklist words and check off packed items to properly pack in said baggage.

2. The electronic device of claim 1 wherein said device contains means for causing it to play previously recording music when said checklist is completed.

3. The electronic device of claim 1 wherein said device contains means for adding unique items to said checklist.

4. An electronic device for reminding a user which contents to pack in a piece of baggage, comprising:

(a) a tag which is attachable to a piece of baggage, (b) a means for attaching said device to a handle of said baggage, (c) a memory which is able to store a plurality of commands and categories, said categories each comprising a multitude of related words, (d) a display which is operatively connected to said memory for displaying said commands and said categories and said words stored in said memory, (e) a plurality of buttons which said user can manipulate to point to said commands and said categories and said words displayed on said display, (f) a memory controller which will:

(1) direct any word which said user selects via said buttons to a location in said memory, beginning at an address corresponding with the location of a checklist; and (2) direct any additional words which said user selects via said buttons to a location in said memory at subsequent checklist addresses in said memory so that all words selected are stored in said memory at said location; and (3) access said checklist from said memory, whereby said display will sequentially display all checklist words on said display, and said user can review said checklist words and check off packed items to properly pack in said baggage.

5. The electronic device of claim 4 wherein said device contains means for causing it to play previously recording music when said checklist is completed.

6. The electronic device of claim 4 wherein said device contains means for adding unique items to said checklist.

7. The electronic device of claim 4 wherein said device contains a keypad for adding unique items to said checklist.

8. A method for reminding a user which contents to pack in a piece of baggage, comprising:

(a) providing an electronic device comprising:

(1) a means for attaching said device to a handle of a piece of baggage, (2) a memory which is able to store a plurality of commands and categories, said categories each comprising a multitude of related words, (3) a display which is operatively connected to said memory for displaying said commands and categories and said words stored in said memory, (4) a pointer means which said user can manipulate to point to said commands and said categories and said words displayed on said display, (5) a memory controller which will:

(i) direct any word which said user selects via said pointer to a location in said memory, beginning at an address corresponding with the location of a checklist; and (ii) direct any additional words which said user selects via said pointer to a location in said memory at subsequent checklist addresses in said memory so that all words selected are stored in said memory at said location; and (iii) access said checklist from said memory, (b) selecting from said categories a plurality of words to store in said checklist; and (c) viewing and reviewing said checklist on said display; whereby said user can review said checklist words and check off packed items to properly pack in said baggage.

* * * * *